US011052439B2

(12) United States Patent
Yoo et al.

(10) Patent No.: US 11,052,439 B2
(45) Date of Patent: Jul. 6, 2021

(54) DEVICE FOR PROCESSING CROSS SECTION OF PIPE

(71) Applicant: DAIKI INDUSTRY CO., LTD., Tatebayashi (JP)

(72) Inventors: Dong Baek Yoo, Tatebayashi (JP); Dong Ki Yoo, Ota (JP)

(73) Assignee: DAIKI INDUSTRY CO., LTD., Tatebayashi (JP)

( * ) Notice: Subject to any disclaimer, the term of this patent is extended or adjusted under 35 U.S.C. 154(b) by 155 days.

(21) Appl. No.: 16/364,995

(22) Filed: Mar. 26, 2019

(65) Prior Publication Data

US 2019/0299264 A1 Oct. 3, 2019

(30) Foreign Application Priority Data

Mar. 29, 2018 (JP) ..... JP2018-063591

(51) Int. Cl.
*B21B 23/00* (2006.01)

(52) U.S. Cl.
CPC ..... *B21B 23/00* (2013.01)

(58) Field of Classification Search
CPC ..... B21D 19/00; B21D 19/02; B21D 19/04; B21D 19/08; B21D 19/088; B21D 41/02; B21D 41/021; B21D 41/023; B21D 41/025; B21D 39/08; B21D 39/12; B29C 57/02; B29C 57/04; B29C 57/045; F16H 2025/204
See application file for complete search history.

(56) References Cited

FOREIGN PATENT DOCUMENTS

| | | | | |
|---|---|---|---|---|
| DE | 77467 | C | 2/1894 | |
| DE | 27 20 825 | A1 | 11/1978 | |
| DE | 10 2013 211 120 | A1 | 12/2014 | |
| JP | H04-17735 | B2 | 3/1992 | |
| JP | H04-118119 | A | 4/1992 | |
| JP | H06-63651 | A | 3/1994 | |
| JP | H06-66828 | | 9/1994 | |
| JP | 2510294 | B2 | 6/1996 | |
| JP | 2512377 | B2 | 7/1996 | |
| JP | H10-146622 | A | 6/1998 | |
| JP | 2002361334 | A * | 12/2002 | ..... B21D 19/04 |
| JP | 3755130 | B2 | 3/2006 | |
| JP | 4709300 | B2 | 6/2011 | |
| JP | 5591134 | B2 | 9/2014 | |

* cited by examiner

*Primary Examiner* — Shelley M Self
*Assistant Examiner* — Kevin E O'Brien
(74) *Attorney, Agent, or Firm* — Studebaker & Brackett PC

(57) ABSTRACT

A pipe cross-section processing device that reduces friction during processing and improves the degree of freedom regarding the rotation angle of the pipe cross section is provided. The pipe cross-section processing device may include a rotation drive source configured to rotate the base, a shaft secured to a front end portion of the base, a slide base capable of a sliding movement along the axis of the shaft, a roller guide member secured to the slide base, a slide-base drive member configured to convert the rotational motion of the base into a linear motion so as to drive the slide base together with the roller guide member in a sliding movement, and a roller configured to be adhered to an inner surface of a pipe cross section to rotationally process a cross section of the pipe outwardly in a radial direction of the pipe.

4 Claims, 4 Drawing Sheets

DEVICE FOR PROCESSING CROSS SECTION OF PIPE

CROSS-REFERENCE TO RELATED APPLICATIONS

This application claims the benefit of Japan Patent Application No. 2018-063591, filed with the Japan Intellectual Property Office on Mar. 29, 2018, the disclosure of which is incorporated herein by reference in its entirety.

BACKGROUND

1. Technical Field

The present invention relates to a pipe cross-section processing device that applies a rotational processing to the cross section of a pipe.

2. Description of the Related Art

To prevent heating pipes from becoming detached and to provide a coupling structure between pipes, the related art employs a process of rotating the front portion of a pipe outwardly in a radial direction of the pipe.

A device for performing such a process is found in Japanese Utility Model Publication 1994-066828 (published Sep. 20, 1994; hereinafter referred to as Utility Model Document 1), which discloses a device for expanding a heating pipe that attaches an expansion piece having a tapering portion onto the front end of a heating pipe exposed at the piping opening of a piping panel and performs a bell mouth processing of rotating the front end of a heating pipe outwardly in a radial direction of the pipe, so that the heating pipe may be prevented from becoming detached from the piping panel.

Also, Utility Model Document 1 discloses a device for expanding a heating pipe including a shape memory alloy expansion member that moves a roller outwardly in a radial direction of the pipe in a rotating manner, so that the roller may move the front end of a heating pipe exposed at the piping hole of a piping panel outwardly in a radial direction of the pipe in a rotating manner according to the rotational driving of a mandrel.

However, the device equipped with an expansion piece having a tapered portion disclosed in Utility Model Document 1 does not offer a degree of freedom in the angle by which the cross section of the pipe may be rotated.

Also, whereas the device equipped with a shape memory alloy expansion member that rotates the roller outwardly with respect to the radial direction of the pipe disclosed in Utility Model Document 1 does offer a certain degree of freedom in the rotated angle of the pipe cross section, there is difficulty in providing a rotation angle of 90° or greater about the central axis of the pipe.

SUMMARY OF THE INVENTION

An embodiment of the invention provides a device for processing a cross section of a pipe that may include: a base 11; a rotation drive source 12 configured to rotate the base 11; a shaft 13 of which one end is secured to a front end portion of the base 11; a slide base 17 which has the shaft 13 inserted therethrough so as to be capable of a sliding movement along the axis of the shaft 13; a roller guide member 18 which is secured to the slide base 17 and in which a roller guide groove 19 is formed; a slide-base drive member 20 configured to convert the rotational motion of the base 11 into a linear motion so as to drive the slide base 17 together with the roller guide member 18 in a sliding movement; and a roller 21 configured to be adhered to an inner surface of a pipe to rotationally process a cross section of the pipe outwardly in a radial direction of the pipe.

The cross section 22*a* at one end of a roller axle 22 within the roller 21 may be connected to a front end side surface of the shaft 13 in a freely rotatable manner, and the cross section 22*b* at the other end of the roller axle 22 may be engaged with the roller guide groove 19, so that the cross section 22*b* at the other end of the roller axle 22 may be configured to undergo a circular motion in an opposite direction of the cross section 22*a* at the one end of the roller axle 22 according to the sliding movement of the slide base 17.

According to an embodiment of the invention, the roller 21 may be adhered to the inside of pipe cross section in rotationally processing the pipe cross section 1*a* outwardly in the radial direction of the pipe, so that the processing may be performed with reduced friction. Also, as the cross section 22*b* on the other end of the roller axle 22 is configured to undergo a circular motion in the opposite direction of the cross section 22*a* on the one end of the roller axle 22 according to the sliding movement of the slide base 17, the degree of freedom may be improved for the rotational angle of the pipe cross section 1*a*. For example, the processing can provide a rotation angle of 90° or greater with respect to the central axis of the pipe.

Also, as the rotational motion of the base 11 applied by the rotation drive source 12 is converted into sliding movement of the slide base 17, the rotational movement of the base 11 and the sliding movement of the slide base 17 can be implemented by a single drive source.

An embodiment of the invention can reduce friction during the processing and can improve the degree of freedom as regards the rotational angle of the pipe cross section. For example, the rotation angle can be processed to a perpendicular angle (90°) or greater with respect to the central axis of the pipe.

Also, the rotational movement of the base and the sliding movement of the slide base can be implemented by a single drive source, whereby the device can be made more compact.

An embodiment of the invention is suitable for forming a pipe coupling structure by rotating the pipe cross sections of two pipes outwardly in a perpendicular angle to form a flange on each pipe and then aligning and fastening the two pipes with each other.

Additional aspects and advantages of the present invention will be set forth in part in the description which follows, and in part will be obvious from the description, or may be learned by practice of the invention.

DETAILED DESCRIPTION OF THE INVENTION

Figure 1:
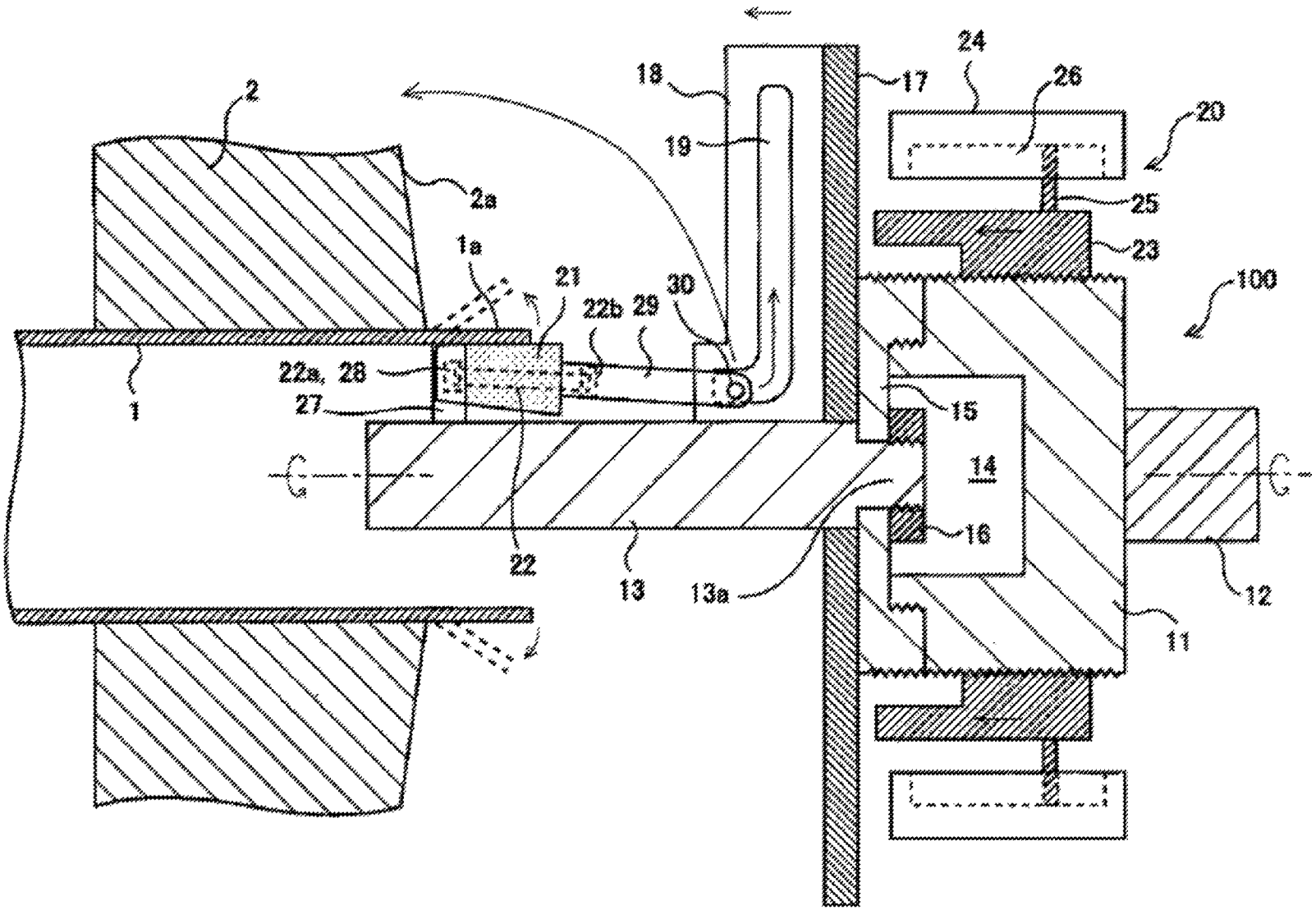
FIG. 1 is a cross-sectional view of a pipe cross-section processing device according to an embodiment of the invention, as seen from the front (with the roller guide member at its initial position).

A pipe cross-section processing device 100 according to an embodiment of the invention is described below with reference to FIG. 1 to FIG. 5.

<Overall Composition of the Pipe Cross-Section Processing Device 100>

The pipe 1 being processed may be held in place by a jig member 2, with the pipe cross section 1*a* exposed from the jig member 2.

A base 11 having a cylindrical shape may be joined to the drive axis of a rotation drive source 12, such as a motor, to be driven in a rotational movement about the cylinder axis of the base 11. At the front end portion of the base 11, one end of a shaft 13 may be secured. This allows the shaft 13 to be driven in a rotational movement together with the base 11 about the axis of the shaft.

In this case, the base 11 may be composed of a concave part 14 and an object (lid) 15 placed over the concave part 14. The cross section 13*a* at one end of the shaft 13 may have a threaded portion, and this threaded portion may be connected to the concave part 14 via a coupling hole formed in the center portion of the object 15 and be screwed tight by a nut 16 at the opposite side of the object (lid) 15. As the object 15 forms an integrated body with the base 11, it can be regarded as a part of the base 11.

The shaft 13 may be inserted through a central hole portion of a slide base 17 having the shape of a circular plate. The shaft 13 may have a polygonal (e.g. quadrilateral) cross section, and the slide base 17 may be configured to slide along the axis of the shaft 13.

A roller guide member 18 may include a roller guide groove 19 and may be secured to a front surface of the slide base 17. A slide-base drive member 20 may convert the rotational motion of the base 11 into a linear motion to drive the slide base 17 together with the roller guide member 18 in a sliding movement. The roller guide groove 19 may include a through-hole that penetrates through the roller guide member 18.

The cross section 22*a* at one end of a roller axle 22 of the roller 21 may be connected to the side surface at the front end of the shaft 13 in a freely rotatable manner, while the cross section 22*b* at the other end of the roller axle 22 may be engaged with the roller guide groove 19. The roller axle 22 may support the roller 21 while allowing it to rotate freely.

The cross section 22*b* at the other end of the roller axle 22 may be configured to move in a circular motion in an opposite direction of the cross section 22*a* at the one end of the roller axle 22 according to the sliding movement of the slide base 17.

Thus, the roller 21 may be installed on the inner surface of the pipe's cross section to perform a rotational processing of the pipe cross section 1*a* outwardly with respect to the radial direction of the pipe. The roller 21 may have a cylindrical or conical roller surface.

According to the pipe cross-section processing device 100, the rotational processing of the pipe cross section 1*a* in an outward direction with respect to the radial direction of the pipe may be performed with the roller 21 adhered to the inside of the pipe cross section, so that the friction experienced during the processing can be reduced. In addition, as the cross section 22*b* at the other end of the roller axle 22 is configured to undergo a circular motion in the opposite direction of the cross section 22*a* at the one end of the roller axle 22 according to the sliding movement of the slide base 17 and roller guide member 18, the degree of freedom may be increased in terms of the rotation angle of the pipe cross section 1*a*. For example, the rotation angle can be made a perpendicular angle (90°) or even a greater angle with respect to the central axis of the pipe.

In this case, the front surface 2*a* of the jig member 2 at the side of the pipe cross section may be a fixed surface up to which the pipe cross section 1*a* may be rotated outwardly in the pipe's radial direction, and depending on its inclination angle with respect to the pipe's central axis, the rotation angle of the pipe cross section 1*a* can be adjusted.

Also, as the sliding movement of the slide base 17 may be obtained by converting the rotational motion of the base 11 being rotated by the rotation drive source 12 into a linear motion, the drive source can be unified.

Figure 2:
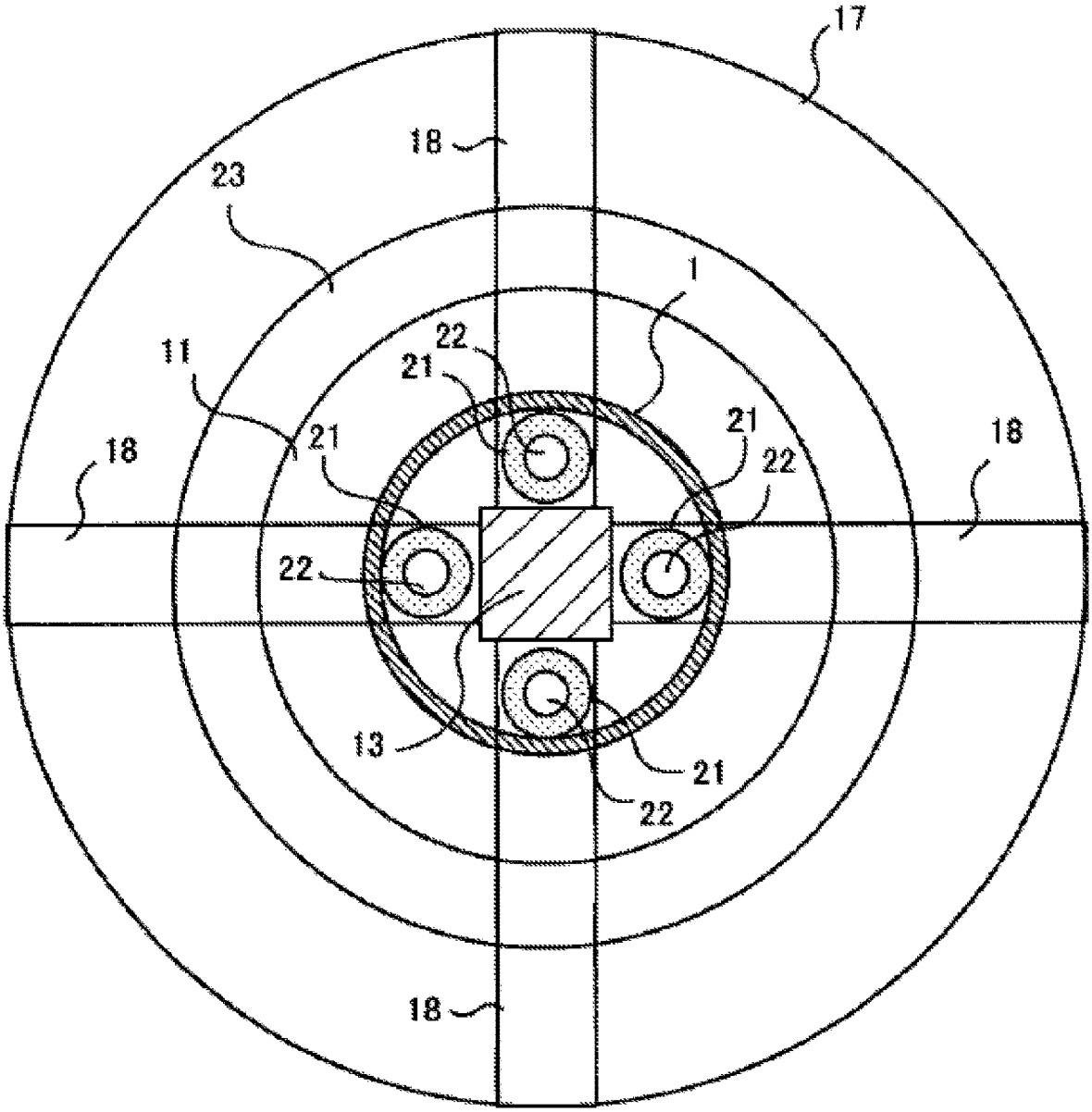
FIG. 2 is a side view of a pipe cross-section processing device according to an embodiment of the invention.

While it is possible to use one set or two sets of rollers 21 and roller guide members 18, it may also be advantageous to have four sets corresponding to four sides of the shaft 13, as illustrated in FIG. 2, as these are rotated evenly along the circumferential direction of the pipe cross section 1*a*.

<Composition of the Slide-Base Drive Member 20>

The slide-base drive member 20 may be secured to the outer perimeter of the base 11 by way of a threaded joint and may include a slide nut 23, of which the front end surface may be in contact with the slide base 17, and a rotation restrictor member 24, which may face the outer perimeter of the slide nut 23 and restrict the rotation of the slide nut 23. As the base 11 moves in a rotational motion, the slide nut 23 may move in a linear motion along the outer perimeter of the base 11, driving the slide base 17 to undergo a sliding movement. It may be advantageous to have the slide nut 23 secured by threads to the outer perimeter of the object 15 also, so as to further elongate the distance of its linear motion.

In this case, if there were no rotation restrictor member 24, the slide nut 23 would rotate together with the base 11 as an integrated body, but due to the rotation restrictor member 24, the slide nut 23 may not rotate but rather may move in a linear motion along the outer perimeter of the base 11 in the direction of the rotational axis.

In this way, the rotation drive source 12 for rotating the base 11 can be used, converting the rotational motion of the base 11 into a linear motion of the slide nut 23.

As a more detailed example of how the rotation of the slide nut 23 may be restrained, a drive member guide pin 25 may be provided perpendicularly on the outer perimeter of the slide nut 23, and a drive member guide groove 26 may be formed in the rotation restrictor member 24. The drive member guide pin 25 may be joined such that it is able to move along the drive member guide groove 26.

<Joint Structure of the Roller 21 and Shaft 13>

Figure 3:
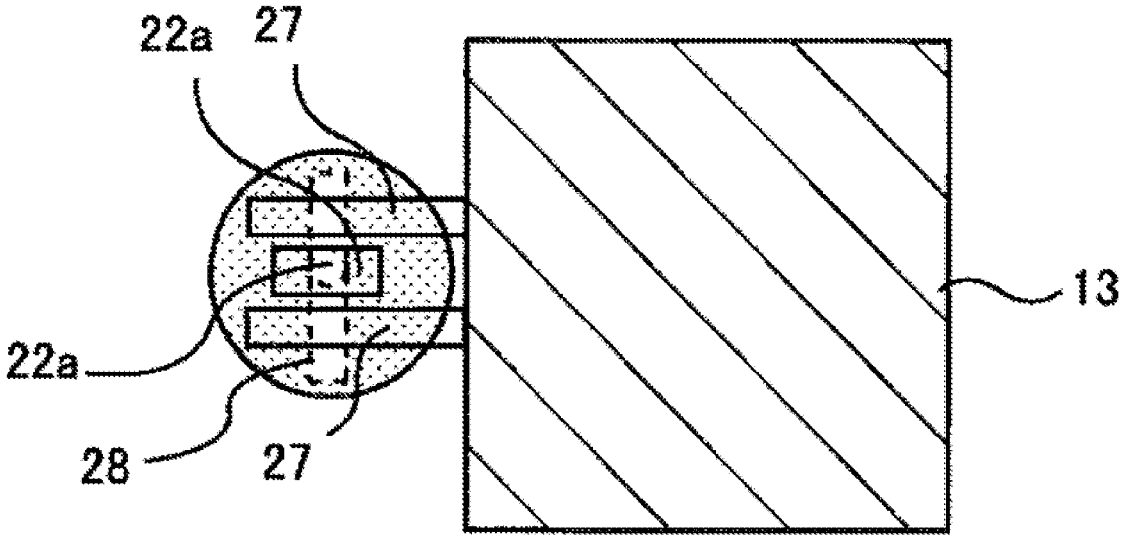
FIG. 3 illustrates a joint structure of the roller and the shaft.

As described above, the cross section 22*a* at one end of the roller axle 22 of the roller 21 may engage the front end side surface of the shaft 13 in a freely rotatable manner. An example of such a composition is described below with reference to FIG. 3. FIG. 3 illustrates this portion as seen from the front end of the shaft 13 of FIG. 1.

A pair of roller support plates 27 may be secured perpendicularly to the front end side surfaces of the shaft 13, and rotary pins 28 may be inserted through guide holes formed in the pair of roller support plates 27 such that the rotary pins 28 are able to rotate freely. Also, the cross section 22*a* at one end of the roller axle 22 may be connected to a center portion of the rotary pin 28, which may be located between a pair of support plates 27. This may allow the roller axle 22 to freely rotate about the cross section 22*a* at the one end.

<Joint Structure of the Roller Axle 22 and Roller Guide Groove 19>

Figure 4:
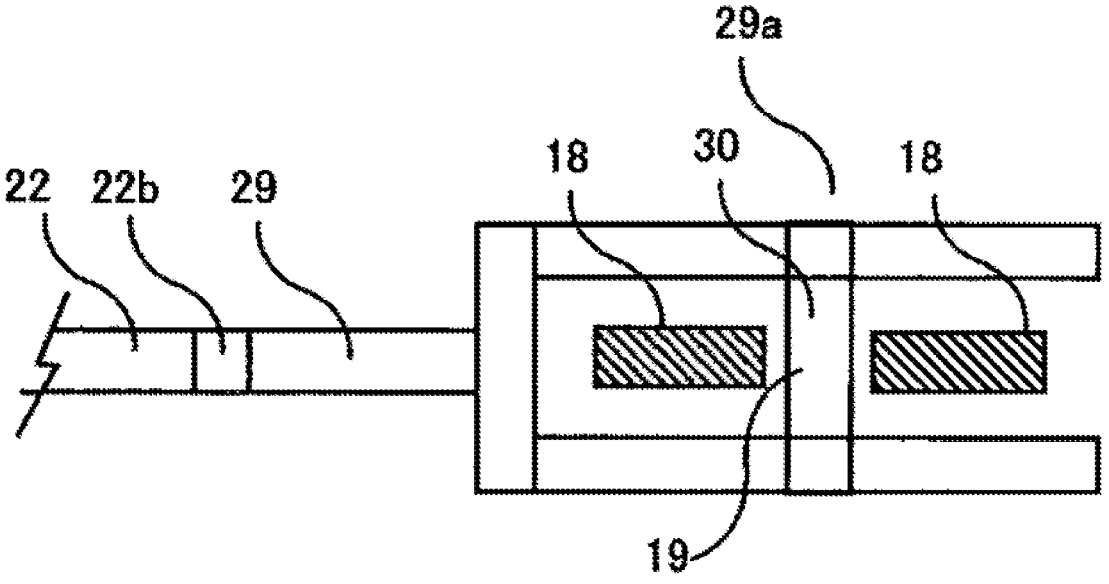
FIG. 4 illustrates a joint structure of the roller and the roller guide member.

As described above, the cross section 22*b* at the other end of the roller axle 22 may engage the roller guide groove 19. An example of such a composition is described below with reference to FIG. 4. FIG. 4 is a cross-sectional view of the roller guide member 18 and a roller arm 29. The cross section of one side of the roller arm 29 may be coupled to the cross section 22*b* at the other end of the roller axle 22, and the cross section of the other side of the roller arm 29 may be coupled to a finger part 29*a*, to which an arm guide pin 30 may be joined.

The arm guide pin 30 may be connected to be movable along the roller guide groove 19. In this example, the roller guide groove 19 may be a through-hole bored into the roller guide member 18, and the arm guide pin 30 may be connected by being inserted into the through-hole. That is, the roller axle 22 may be coupled to the roller guide groove 19 by way of the roller arm 29 and arm guide pin 30 arranged in-between.

In this way, the arm guide pin 30 joined to the cross section on the other side of the roller arm 29 may undergo a circular motion with respect to the cross section 22*a* at the one end of the roller axle 22, according to the sliding movement of the roller guide member 18, so that the cross section 22*b* at the other end of the roller axle 22 may also be moved in a circular motion in an opposite direction of the cross section 22*a* at the one end of the roller axle 22 according to the sliding movement of the slide base 17.

<Operation of the Pipe Cross-Section Processing Device 100>

Next, the operation of the pipe cross-section processing device 100 is described below with reference to FIG. 1 and FIG. 5. Firstly, in the initial state shown in FIG. 1, the pipe 1 may be secured by the jig member 2, and the shaft 13 may be inserted into the pipe 1. Here, the pipe cross section 1*a* may be exposed at the jig member 2, and the roller 21 may be connected to be in contact with the inside of the cross section of the pipe 1.

Then, when the rotation drive source 12 is turned on to a regular rotation mode to rotate the base 11 and the shaft 13, the roller 21 may rotate while spinning along the inner perimeter of the pipe cross section. According to the rotation of the base 11, the slide nut 23 may move in a straight line in the direction of the front end of the shaft 13 until its front end contacts the slide base 17.

Figure 5:
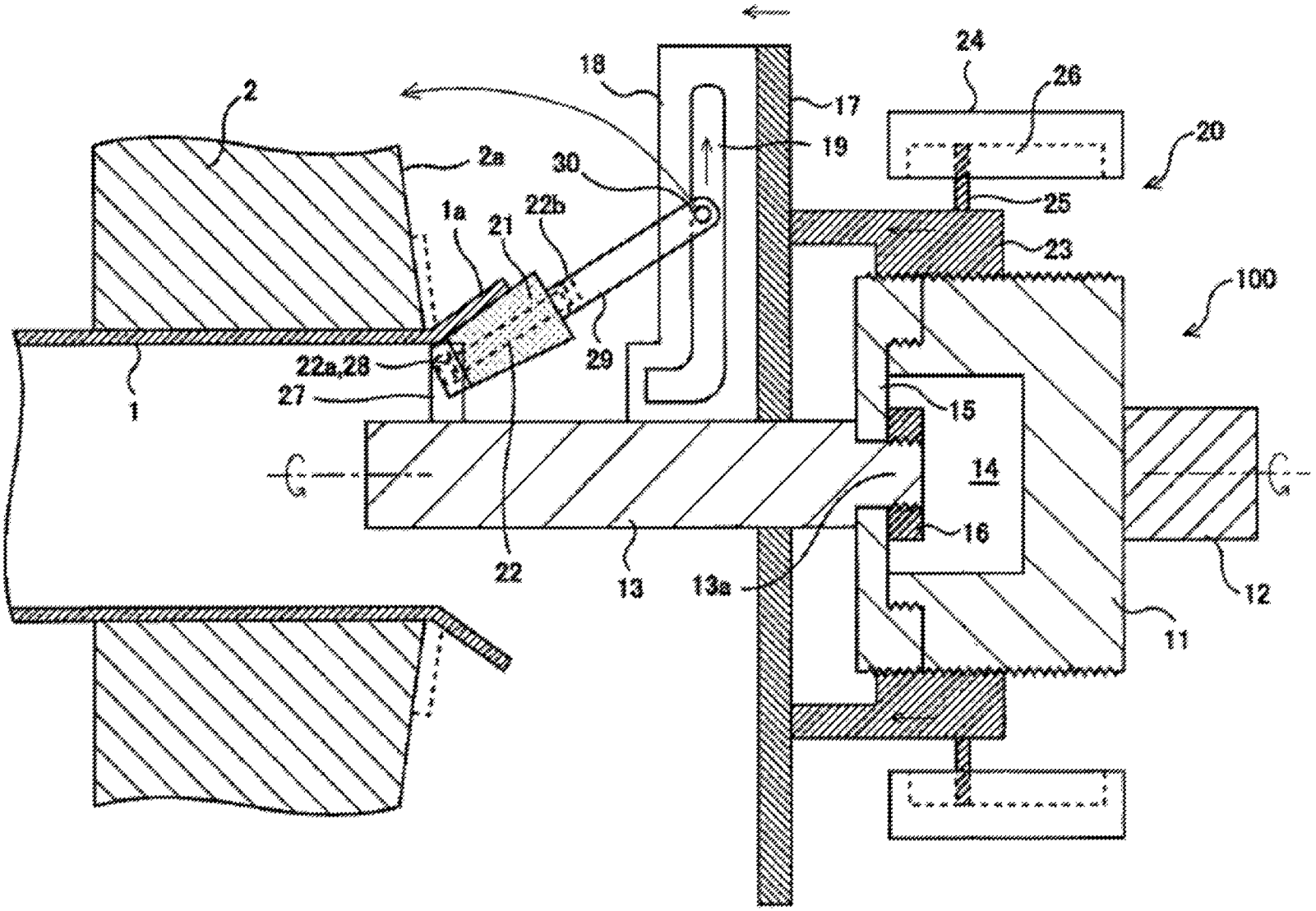
FIG. 5 is a cross-sectional view of a pipe cross-section processing device according to an embodiment of the invention, as seen from the front (after the roller guide member has undergone sliding).

As illustrated in FIG. 5, if the slide nut 23 moves further forward, the slide base 17 and the roller guide member 18 may slide, and accordingly, the arm guide pin 30 joined with the roller arm 29 may move along the roller guide groove 19.

As the cross section 22*b* at the other end of the roller axle 22 is thus made to undergo a circular motion in an opposite direction of the cross section 22*a* at the one end of the roller axle 22, the roller 21 may be adhered to the inside surface of the pipe cross section and may continue to rotate outwardly with respect to the radial direction of the pipe cross section 1*a*. When the slide nut 23 moves further forward from the state shown in FIG. 5, the rotation angle of the pipe cross section 1*a* may be increased, until ultimately the pipe cross section 1*a* may join the front surface 2*a* of the jig member 2 at the side of the pipe cross section.

Thus, the rotational processing of the pipe cross section 1*a* may be completed. Afterwards, the shaft 13 may be pulled out from the pipe 1. Then, the rotation drive source 12 may be turned on to a reverse rotation mode, rotating the base 11 in a reverse direction. This may cause the slide nut 23 to retreat and return to its initial position. By sliding the slide base 17 in reverse, the slide base 17 and the roller guide member 18 may be returned to their initial positions.

The pipe cross-section processing device 100 may be suitable for forming a pipe coupling structure by rotating the pipe cross sections 1*a* of two pipes 1 outwardly in the radial directions of the pipes, in opposite directions of the pipes' axes, rotating the pipe cross sections 1*a* back in a perpendicular angle to form a flange on each pipe and then aligning and fastening the two pipes with each other. In such cases, the rotated portions of the pipe cross section 1*a* tend to return to angles that are somewhat smaller than right angles due to elastic restoration, so that it may be necessary to rotate the pipe cross sections to angles that are equal to or greater than right angles in consideration of such elastic restorative forces. Therefore, the inclination angle of the front surface 2*a* of the jig member 2 at the side of the pipe cross section may be made greater than a perpendicular angle.

What is claimed is:

1. A device for processing a cross section of a pipe, the device comprising:

a base;

a rotation drive source configured to rotate the base;

a shaft having one end thereof secured to a front end portion of the base;

a slide base having the shaft inserted therethrough to be capable of a sliding movement along an axis of the shaft;

a roller guide member secured to the slide base and comprising a roller guide groove formed therein;

a slide-base drive member configured to convert a rotational motion of the base into a linear motion so as to drive the slide base together with the roller guide member in a sliding movement; and a roller configured to adhere to an inner surface of a pipe and configured to rotationally process a cross section of the pipe outwardly in a radial direction of the pipe, wherein one end of a roller axle within the roller is joined to a front end side surface of the shaft such that the one end of the roller axle is freely rotatable, the other end of the roller axle is connected to the roller guide groove, and the other end of the roller axle is configured to undergo a circular motion according to the sliding movement of the slide base, wherein the slide-base drive member comprises:

a slide nut secured to an outer perimeter of the base and having a front end surface thereof touching and connected with the slide base; and a rotation restrictor connected to an outer perimeter of the slide nut to restrict a rotation of the slide nut, and wherein the slide nut moves in a linear motion along the outer perimeter of the base together with the rotational motion of the base to drive the slide base in a sliding movement.

2. The device for processing a cross section of a pipe according to claim 1, further comprising:

a drive member guide pin secured perpendicularly to an outer perimeter of the slide nut, wherein the rotation restrictor comprises a drive member guide groove, and the drive member guide pin is connected to be movable along the drive member guide groove.

3. The device for processing a cross section of a pipe according to claim 1, further comprising:

a pair of roller support plates formed perpendicularly at a front end side surface of the shaft; and a rotary pin inserted through and connected to a guide hole formed in the pair of roller support plates such that the rotary pin is freely rotatable, wherein the one end of the roller axle is coupled to the rotary pin.

4. The device for processing a cross section of a pipe according to claim 1, further comprising:

a roller arm having one end coupled to the one end of the roller axle, and an arm guide pin coupled to the other end of the roller arm, wherein the arm guide pin is connected to be movable along the roller guide groove.

* * * * *